US005088381A

United States Patent [19]

Lamarque et al.

[11] Patent Number: 5,088,381

[45] Date of Patent: Feb. 18, 1992

[54] PROJECTILE-LAUNCHER ACTUATED BY INDUCTION

[75] Inventors: Etienne Lamarque, Orleans; Jacques Rabuel, deceased, late of Paris, by Jean Rabuel, Marcelle Jacquemin, legal representatives; Jean Sikora, Olivet, all of France

[73] Assignee: Thomson-Brandt Armements, Boulogne Billancourt, France

[21] Appl. No.: 662,516

[22] Filed: Feb. 28, 1991

Related U.S. Application Data

[63] Continuation of Ser. No. 390,889, Aug. 8, 1989, abandoned.

[30] Foreign Application Priority Data

Aug. 9, 1988 [FR] France ..... 88 10730

[51] Int. Cl.[5] ..... F41F 3/04; F41F 3/055

[52] U.S. Cl. ..... 89/1.814; 102/209; 89/6.5

[58] Field of Search ..... 89/1.814, 6.5; 102/209

[56] References Cited

U.S. PATENT DOCUMENTS

| | | | |
|---|---|---|---|
| 2,555,384 | 6/1951 | Watt | 89/6.5 |
| 3,038,384 | 6/1962 | Gaugler | 89/1.814 |
| 3,841,197 | 10/1974 | Morrisey | 89/1.816 |
| 4,038,902 | 8/1977 | Welsh | 89/1.814 |
| 4,063,485 | 12/1977 | Carter et al. | 89/1.814 |
| 4,099,038 | 7/1978 | Purdy | 200/61.08 |
| 4,412,475 | 11/1983 | Hornby | 89/1.816 |
| 4,442,067 | 4/1984 | Saito et al. | 420/428 |
| 4,677,376 | 6/1987 | Ettel et al. | 324/179 |

FOREIGN PATENT DOCUMENTS

| | | |
|---|---|---|
| 1508326 | 11/1967 | France . |
| 2431673 | 2/1980 | France . |
| 1158716 | 7/1969 | United Kingdom . |

OTHER PUBLICATIONS

Halliday et al, Physics, 8/1970, p. 511.

Henderson et al, Metallurgical Dictionary, "Alloys-Steel", Stell-Austenitic and Austenitic Stainless Steels, pp. 14, 307 and 378-379, 1953.

*Primary Examiner*—Stephen C. Bentley

*Attorney, Agent, or Firm*—Oblon, Spivak, McClelland, Maier & Neustadt

[57] ABSTRACT

In a projectile-launcher actuated by induction, the guidance tubes are made of austenitic, stainless steel with high resistivity, transparent to the induction phenomenon. This makes it possible to obtain optimal mechanical strength while at the same time deriving the benefit of the advantages of actuation by induction between an inducation coil wound on each tube and an armature winding wound on the projectile. The disclosed device can be applied to all types of ground or airborne rocket-launchers.

10 Claims, 2 Drawing Sheets

PROJECTILE-LAUNCHER ACTUATED BY INDUCTION

This application is a continuation of application Ser. No. 07/390,889, filed on Aug. 8, 1989, now abandoned.

BACKGROUND OF THE INVENTION a) Field of the Invention

The invention concerns a projectile launcher actuated by induction.

A projectile-launcher, such as a rocket-launcher for example, is formed by a plurality of projectile guidance tubes, joined together by straps inside a casing, with electrical connection means that notably provide for the firing and remote control of the projectiles.

b) Description of the Prior Art

There is a known way, described by the French patent No. 2431673, filed on behalf of the Applicant, to use guidance tubes made of insulating material and to set up, around these tubes and around each projectile, an induction coil through which it is possible, without using additional connectors, to transmit the signals and energy needed for the programming as well as the firing of the rocket. It turns out that a structure such as this does not have the qualities of mechanical strength required for certain applications.

An object of the present invention, precisely, is to overcome this drawback, and concerns a rocket-launcher which combines the advantages of actuation by induction with those of a very strong metallic structure.

It also concerns a novel architecture enabling the installation of actuation circuits that are particularly protected because they are, to a great extent, on the periphery of the structure.

SUMMARY OF THE INVENTION

More precisely, the invention concerns a projectile-launcher actuated by induction, comprising a plurality of tubes for the guidance of projectiles, each fitted out, respectively, with an induction coil and an armature winding capable of transmitting, by induction, signals and the energy needed for the warhead programming and firing of the projectiles, wherein each of the guidance tubes is made of a metallic non-magnetic material, with high resistivity ($\rho$), capable of fulfilling the guidance function through high mechanical strength while, at the same time, being transparent with respect to the induction phenomenon.

BRIEF DESCRIPTION OF THE DRAWINGS

The invention will be better understood from the following explanations and the appended figures, of which.

DETAILED DESCRIPTION OF THE PREFERRED EMBODIMENT

For greater clarity, the same references are repeated for the same elements in all the figures.

Figure 1:
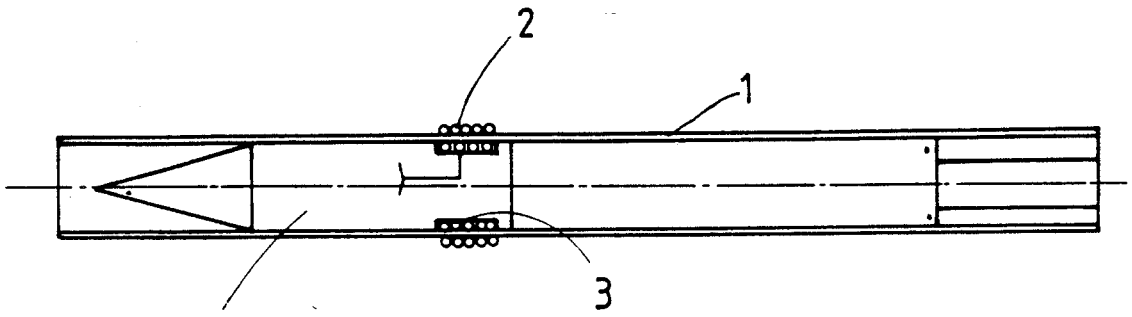
FIG. 1 is a schematic view illustrating a tube for the guidance of a projectile fitted out with actuation means according to the invention.

As FIG. 1 shows, an induction coil (2) is wound on the guidance tube which, according to an essential characteristic of the invention, is a metallic tube (1). The metal forming this tube is of a determined nature as specified below. An armature winding (3) is wound on the projectile which, in the present case, is a rocket (100), for example. The windings should be face to face, at least at a given moment. Under these conditions, the excitation of the inductor by electrical pulses enables the electromagnetic transmission of energy and information to the projectile by means of the armature winding (3)

FIG. 1 illustrates a variant wherein, at rest, before the launching, the induction coil (2) and the armature winding (3), face each other.

Figure 2:
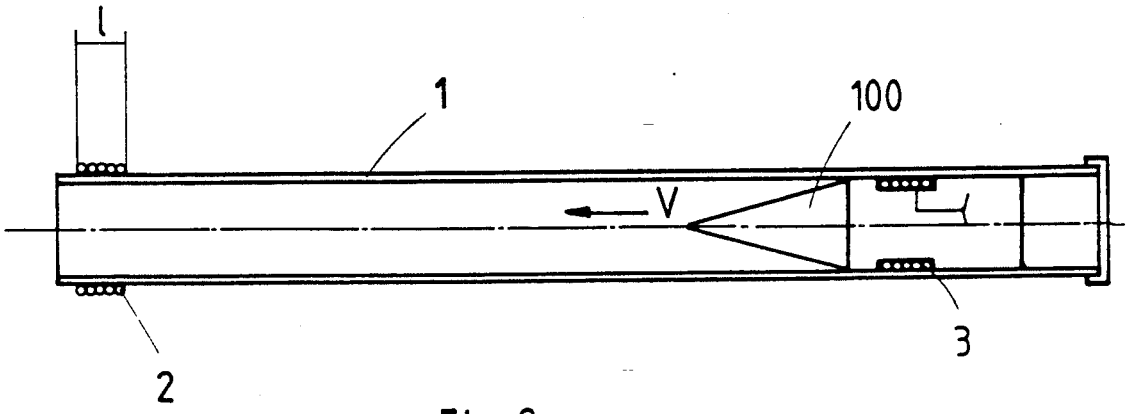
FIG. 2 shows a variant embodiment.

FIG. 2 illustrates a variant wherein the armature winding (3) faces the induction coil (2) only when moving in the guidance tube (1) of the projectile (100) which, at rest, is behind the tube (1). In this case, the length (l) of the induction coil (2) is adapted to the speed of ejection (V) of the projectile in such a way that the armature winding (3) faces the induction coil (2) for a period of time which is sufficient for actuation by induction to take place.

As stated previously, a major characteristic of the invention lies in the choice of the material forming the guidance tube (1). This material is a steel with the following characteristics:

- it should have resistivity ($\rho$) which is as high as possible to reduce eddy currents to the maximum degree;
- the relative permeability of the material should be as close as possible to 1, which is the characteristic of a non-magnetic material.

It is observed that increasing the percentage of nickel increases the resistivity of the material. However, this increase tends to reduce the mechanical strength of the alloy. The Applicant has made a selection, in the choice of the material, that leads to obtaining the following characteristics conjointly: mechanical strength of the tube and resistance to aggressive agents resulting from the combustion of the propellent of the projectile or gases generated by the triggering of an expulsion charge. This is achieved without harming the resistivity which is an essential parameter in the application, as stated earlier. The material chosen for the metallic tube (1) is an austenitic, stainless steel, for example one that conforms to the standard designation Z.6.CN.18-10 or Z.2.CN.D.17-12 (corresponding respectively to U.S. Standard Designations AISI-304HAISI-316L).

Figure 3:
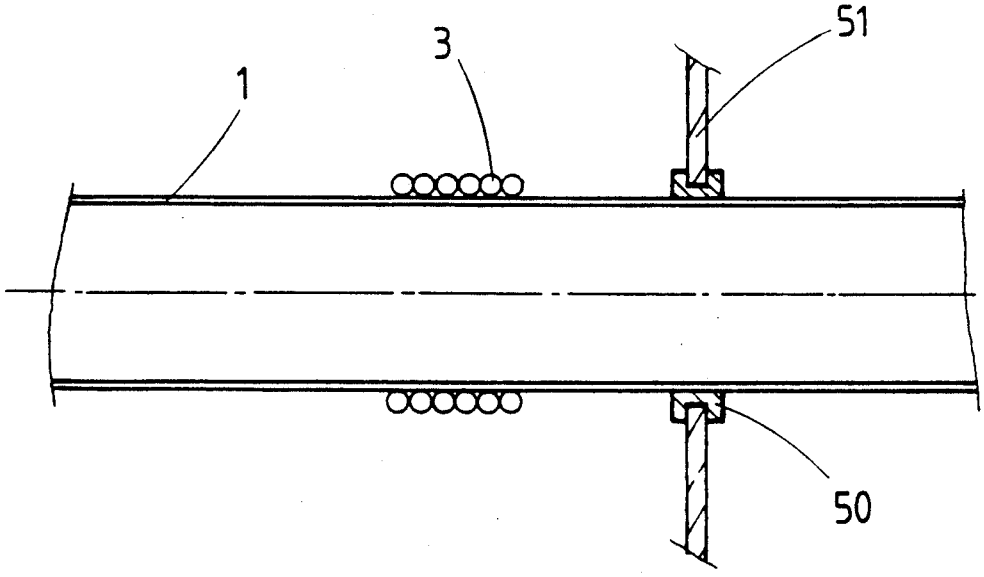
FIG. 3 illustrates a detail of the structure according to the invention.

As shown in FIG. 3, to prevent any risk of short-circuiting, the bearings (51) supporting the tube (1) are electrically insulated from it by an insulating ring (50).

Figure 4:
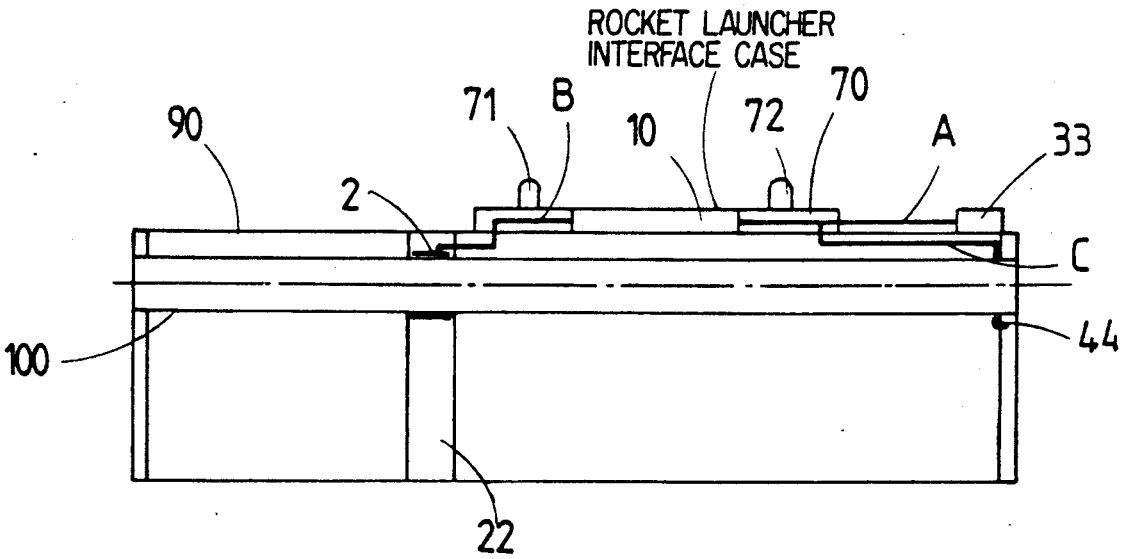
FIG. 4 is a schematic illustration of the arrangement, with respect to one another, of the actuation means according to the invention.

FIG. 4 schematically illustrates a novel architecture of the electric circuit implemented according to the present invention. This circuit comprises:

- A rocket-launcher interface casing, called BILR (10);
- An inductor-holder bearing (22);
- A rocket-launcher supply connector (33);
- A flange(44) for rocket firing connector;
- Three electrical connection cables A-B-C connecting these sub-units to one another.

The rocket-launcher interface case (10) fulfils the functions stated below, on the basis of commands coming from the connector (33). It provides for the initiation of the induction coils (2) to enable the transmission, by electromagnetic coupling, of the charge, and the time-setting of a fuse located in the head of the projectile. It generates commands for the firing of the electropyrotechnical device of the propellent charge of the projectile.

According to a characteristic of the invention, the electronic part of the interface casing (10) is moulded in a metallic case (70) acting as a shield against electromagnetic disturbances. This case (70) is fixed to the upper part of the structure (90) of the rocket-launcher, for example between the points (71, 72) by which the set is hooked on to an aircraft (not shown) that carries it. The inductor-holder bearing (22) is used to position induction coils (2) around the launching tubes (1), irrespectively of the number of these launching tubes (1), only one of which is shown in FIG. 4.

The rocket-launcher supply connector (33) provides for the transfer of information between the aircraft and the interface casing (10). The flange (44) holding the firing connector is a bearing located at the rear end of the rocket-launcher. It fulfils at least two functions: the holding of each guidance tube (100) and the positioning of the firing connectors corresponding to each of the tubes.

According to another characteristic of the invention, there are three connecting cables, referenced (A), (B) and (C). The first cable (A) connects the interface casing (10) to the supply connector (33) of the rocket-launcher. The second cable (B) connects the interface casing (10) to the bearing (22) that holds the induction coil (2). The third cable (C) connects the interface casing (10) to the flange (44) holding the firing connectors. Each of the cables, which are armored, has a plurality of conductors, which are also armored. They are fixed to the periphery of the structure (90) unlike in the prior art while being, at the same time, streamlined. They then spread out at the flange (44) and the bearing (22) to reach the corresponding inductors and firing connectors.

This is a simple organization of the electrical circuit and of the different control elements of the projectile-launcher which are on the periphery of the structure.

The invention can be applied to all types of fixed or airborne projectile-launchers. It provides high mechanical strength while, at the same time, enabling flexible and sure electrical actuation.

We claim:

1. A projectile-launcher activated by induction, comprising a plurality of tubes for the guidance of projectiles, each fitted out, respectfully, with an induction coil and an armature winding capable of transmitting, by induction, signals and the energy needed for the warhead programming and firing up the projectiles;

wherein each of the guidance tubes is made of austenitic, nickel-alloy steel of the kind corresponding to U.S. Standard Designation AISI-304H or AISI-316L which is a metallic non-magnetic material, with high resistivity ($\rho$), capable of fulfilling the guidance function through high mechanical strength while, at the same time, being transparent with respect to the induction phenomenon.

2. Projectile-launcher according to claim 1, wherein the induction coil is positioned facing the armature winding when the projectile is at rest in its guidance tube.

3. Projectile-launcher according to claim 1, wherein the induction coil positioned in front of the guidance tube, on the outgoing side of the projectile, and the armature winding is positioned on the projectile which is at rest, behind the guidance tube, the length of induction coil being such that, depending on the speed of ejection of the projectile, its armature winding faces the induction coil for a period which is sufficient for the actuation by induction to take place.

4. Projectile-launcher according to claim 1, wherein the bearings supporting the tube are electrically insulated from it by an insulating ring.

5. Projectile-launcher according to claim 1, wherein a rocket-launcher interface casing is moulded in a metallic case fixed to the upper part of a structure of the projectile-launcher.

6. Projectile-launcher according to claim 5, wherein the case is fixed between the points at which the set is hooked on to the aircraft carrying it.

7. Projectile-launcher according to claim 5, wherein an armored conductor connects the interface casing to a supply connector.

8. Projectile-launcher according to claim 5, wherein an armored conductor connects the interface casing to the bearing that holds the induction coils wound on the guidance tubes.

9. Projectile-launcher according to claim 5, wherein an armored conductor connects the interface casing to a firing connector holding flange.

10. Projectile-launcher according to one of the claims 7, 8 and 9, wherein these armored conductors are fixed to the periphery of the structure, while at the same time being streamlined, and then spread out near the flange and the bearing to reach the induction coils and the armature windings.

* * * * *